US011243487B2

(12) United States Patent
Miyashita et al.

(10) Patent No.: US 11,243,487 B2
(45) Date of Patent: Feb. 8, 2022

(54) HEATING UNIT WITH SUPPORT MEMBER AND IMAGE PROCESSING APPARATUS INCORPORATING A HEATING UNIT

(71) Applicant: TOSHIBA TEC KABUSHIKI KAISHA, Tokyo (JP)

(72) Inventors: Kousei Miyashita, Sunto Shizuoka (JP); Sasuke Endo, Chigasaki Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/936,908

(22) Filed: Jul. 23, 2020

(65) Prior Publication Data

US 2021/0132526 A1 May 6, 2021

(30) Foreign Application Priority Data

Nov. 1, 2019 (JP) ..... JP2019-199740

(51) Int. Cl.
*G03G 15/20* (2006.01)

(52) U.S. Cl.
CPC ..... *G03G 15/2028* (2013.01); *G03G 15/2017* (2013.01); *G03G 15/2057* (2013.01); *G03G 15/2064* (2013.01); *G03G 2215/2035* (2013.01)

(58) Field of Classification Search
CPC ..... G03G 15/2028; G03G 15/2057; G03G 15/2064; G03G 15/2053; G03G 15/2017;
(Continued)

(56) References Cited

U.S. PATENT DOCUMENTS

2003/0170054 A1* 9/2003 Suzuki ..... G03G 15/2064 399/328
2011/0318073 A1* 12/2011 Arikawa ..... G03G 15/2032 399/329

(Continued)

FOREIGN PATENT DOCUMENTS

| | | | |
|---|---|---|---|
| EP | 3550374 | A1 | 10/2019 |
| JP | 2006091499 | A | 4/2006 |
| JP | 2008140701 | A | 6/2008 |

OTHER PUBLICATIONS

Extended European Search Report dated Feb. 17, 2021, mailed in counterpart European Application No. 20194379.2, 8 pages.

*Primary Examiner* — Walter L Lindsay, Jr.
*Assistant Examiner* — Laura Roth
(74) *Attorney, Agent, or Firm* — Kim & Stewart LLP

(57) ABSTRACT

A heating unit includes a rotating cylinder rotating about an axis parallel to a first direction. A heater having a width in a second direction is on the inner surface of the cylinder. A support member holds the heater fixed relative to the cylinder and includes an upstream member adjacent to the heater in the second direction and a downstream member adjacent to the heater in the second direction. The support member has upstream ribs on the upstream member and downstream ribs on the downstream member, each rib having a curved shape facing the inner surface of the rotating cylinder and being spaced from each other in the first direction. The heating unit may include, in some examples, a stay supporting the support member, a guide member on the stay, and a temperature sensor.

14 Claims, 16 Drawing Sheets

(58) Field of Classification Search
CPC ... G03G 2215/2016; G03G 2215/2035; G03G 2215/2041
See application file for complete search history.

(56) References Cited

U.S. PATENT DOCUMENTS

| | | | | |
|---|---|---|---|---|
| 2014/0294467 | A1* | 10/2014 | Ishida | G03G 15/2039 399/329 |
| 2015/0277306 | A1* | 10/2015 | Kondo | G03G 15/2039 399/33 |
| 2016/0231675 | A1* | 8/2016 | Ishida | G03G 15/2053 |
| 2016/0327900 | A1* | 11/2016 | Tanaka | G03G 21/1647 |
| 2016/0378028 | A1* | 12/2016 | Fujiwara | G03G 15/2028 399/323 |
| 2019/0286026 | A1 | 9/2019 | Furuichi et al. | |
| 2019/0286027 | A1* | 9/2019 | Someya | G03G 15/2064 |
| 2020/0209791 | A1* | 7/2020 | Seki | G03G 15/2042 |

* cited by examiner

HEATING UNIT WITH SUPPORT MEMBER AND IMAGE PROCESSING APPARATUS INCORPORATING A HEATING UNIT

CROSS-REFERENCE TO RELATED APPLICATIONS

This application is based upon and claims the benefit of priority from Japanese Patent Application No. 2019-199740, filed on Nov. 1, 2019, the entire contents of which are incorporated herein by reference.

FIELD

The present disclosure relates to a heating unit and an image processing apparatus.

BACKGROUND

An image forming apparatus that forms an image on a sheet is known. The image forming apparatus includes a heating unit for fixing a toner (or other recording agent) to the sheet. It is preferable that temperature unevenness in the heating unit be reduced.

DETAILED DESCRIPTION

According to one embodiment, a heating unit includes a rotating cylinder of a film material. The rotating cylinder has a length in a first direction and is configured to rotate about an axis parallel to the first direction. A heater is on an inner surface of the rotating cylinder and has a length in the first direction and a width in a second direction orthogonal to the first direction. The second direction is aligned with a rotational direction of the rotating cylinder. A support member holds the heater in a fixed position relative to the rotating cylinder. The support member includes: an upstream member on the inner surface of the rotating cylinder, adjacent to the heater in the second direction on an upstream side of the heater in the rotational direction of the rotating cylinder; a downstream member on the inner surface of the rotating cylinder, adjacent to the heater in the second direction on a downstream side of the heater in the rotational direction of the rotating cylinder cylindrical portion; a plurality of upstream ribs on the upstream member, the upstream ribs extending in a third direction orthogonal to the second direction, each upstream rib having a curved shape facing the inner surface of the rotating cylinder, the upstream ribs supporting the rotating cylinder and spaced from each other in the first direction; and a plurality of downstream ribs on the downstream member, the downstream ribs extending in the third direction, each downstream rib having a curved shape facing the inner surface of the rotating cylinder, the downstream ribs supporting the rotating cylinder and spaced from each other in the first direction.

Hereinafter, a heating unit and an image processing apparatus according to certain example embodiment will be described with reference to the drawings.

Figure 1:
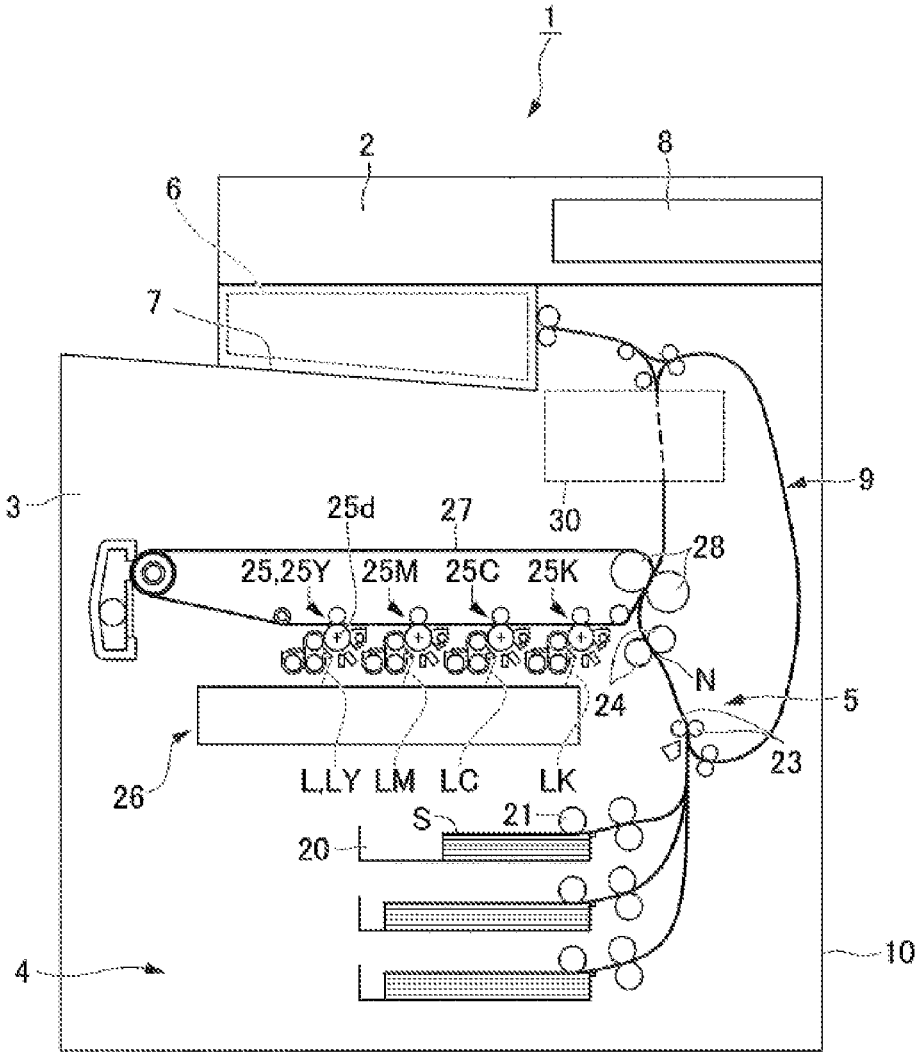
FIG. 1 depicts a schematic configuration of an image processing apparatus according to an embodiment.

FIG. 1 is a schematic configuration diagram of an image processing apparatus according to one embodiment. The image processing apparatus according to this embodiment is referred to as an image forming apparatus 1. The image forming apparatus 1 performs processing for forming an image on a sheet S. The sheet S may be paper or the like.

The image forming apparatus 1 includes a housing 10, a scanner unit 2, an image forming unit 3, a sheet supply unit 4, a conveying unit 5, a sheet discharge tray 7, an inversion unit 9, a control panel 8, and a controller 6.

The housing 10 forms an outer shape of the image forming apparatus 1.

The scanner unit 2 reads image information of a copy target (an original document or the like) as signals of brightness and darkness of reflected light, and generates image data according to the signals. The scanner unit 2 outputs the generated image data to the image forming unit 3.

The image forming unit 3 forms a toner image with a toner or other recording agent material on a basis of the image data received from the scanner unit 2 or image data received from the outside (e.g., from an external device such as a networked computer). The image forming unit 3 transfers the toner image onto the surface of the sheet S. The image forming unit 3 heats and presses the toner image on the surface of the sheet S, and thus fixes the toner image to the sheet S.

The sheet supply unit 4 supplies the sheets S one by one to the conveying unit 5 in accordance with the timing at which the image forming unit 3 forms the toner image.

The sheet supply unit 4 has an accommodating portion 20 and a pickup roller 21.

The accommodating portion 20 houses sheets S of a predetermined size and type.

The pickup roller 21 picks up a sheet S from the accommodating portion 20. The pickup roller 21 supplies the taken-out sheet S to the conveying unit 5.

The conveying unit 5 conveys the sheet S from the sheet supply unit 4 to the image forming unit 3. The conveying unit 5 includes a conveying roller 23 and a registration roller 24.

The conveying roller 23 conveys the sheet S from the pickup roller 21 to the registration roller 24. The conveying roller 23 makes a leading end of the sheet S in the conveyance direction abut against a nip N of the registration roller 24.

The registration roller 24 bends the sheet S at the nip N, thereby adjusting the position of the leading end of the sheet S along the conveyance direction.

The registration roller 24 conveys the sheet S in accordance with the timing at which the image forming unit 3 transfers the toner image to the sheet S.

The image forming unit 3 includes a plurality of image forming devices 25, a laser scanning unit 26, an intermediate transfer belt 27, a transfer unit 28, and a fixing unit 30.

Each image forming device 25 includes a photosensitive drum 25*d*. Each image forming device 25 forms a toner image, in accordance with image data (from the scanner unit 2 or the outside), on the photosensitive drum 25*d*. The plurality of image forming devices 25 are provided in this example for each of the toner colors yellow, magenta, cyan, and black. The image forming units 25Y, 25M, 25C, and 25K form toner images of yellow, magenta, cyan, and black, respectively.

An electrostatic charger, a developing device, and the like are disposed around the photosensitive drums 25*d*. The electrostatic charger charges a surface of the photosensitive drum 25*d*. The developing device contains developer containing toner one of the colors yellow, magenta, cyan, and black. The developing device develops an electrostatic latent image formed on the photosensitive drum 25*d* by selective exposure with light. As a result, toner images formed by the toners of the respective colors are formed on the photosensitive drums 25*d*.

The laser scanning unit 26 scans the charged photosensitive drums 25*d* with a laser beam L, and exposes the photosensitive drums 25*d*. The laser scanning unit 26 exposes the photosensitive drums 25*d* of each of the image forming devices 25Y, 25M, 25C, and 25K with respective different laser beams LY, LM, LC, and LK. Accordingly, the laser scanning unit 26 forms an electrostatic latent image on each of photosensitive drums 25*d*.

The toner image on the surface of each of the photosensitive drums 25*d* is transferred to the intermediate transfer belt 27 (primary transfer).

The transfer unit 28 then transfers the toner image on the intermediate transfer belt 27 to the sheet S at a secondary transfer position (secondary transfer).

The fixing unit 30 heats and presses the toner image to the sheet S, and thereby fixes the toner image to the sheet S.

The reversing unit 9 inverts the sheet S to form an image on the back surface of the sheet S. The reversing unit 9 reverses a sheet S discharged from the fixing unit 30 using a switchback or the like. The reversing unit 9 conveys the inverted sheet S back towards the registration roller 24.

The sheet discharge tray 7 holds the printed sheets S after discharge from the fixing unit 30 or the like.

The control panel 8 is a part of an input unit for an operator to input information for operating the image forming apparatus 1. The control panel 8 includes a touch panel and various kinds of hard keys.

The controller 6 controls the respective components of the image forming apparatus 1.

Figure 2:
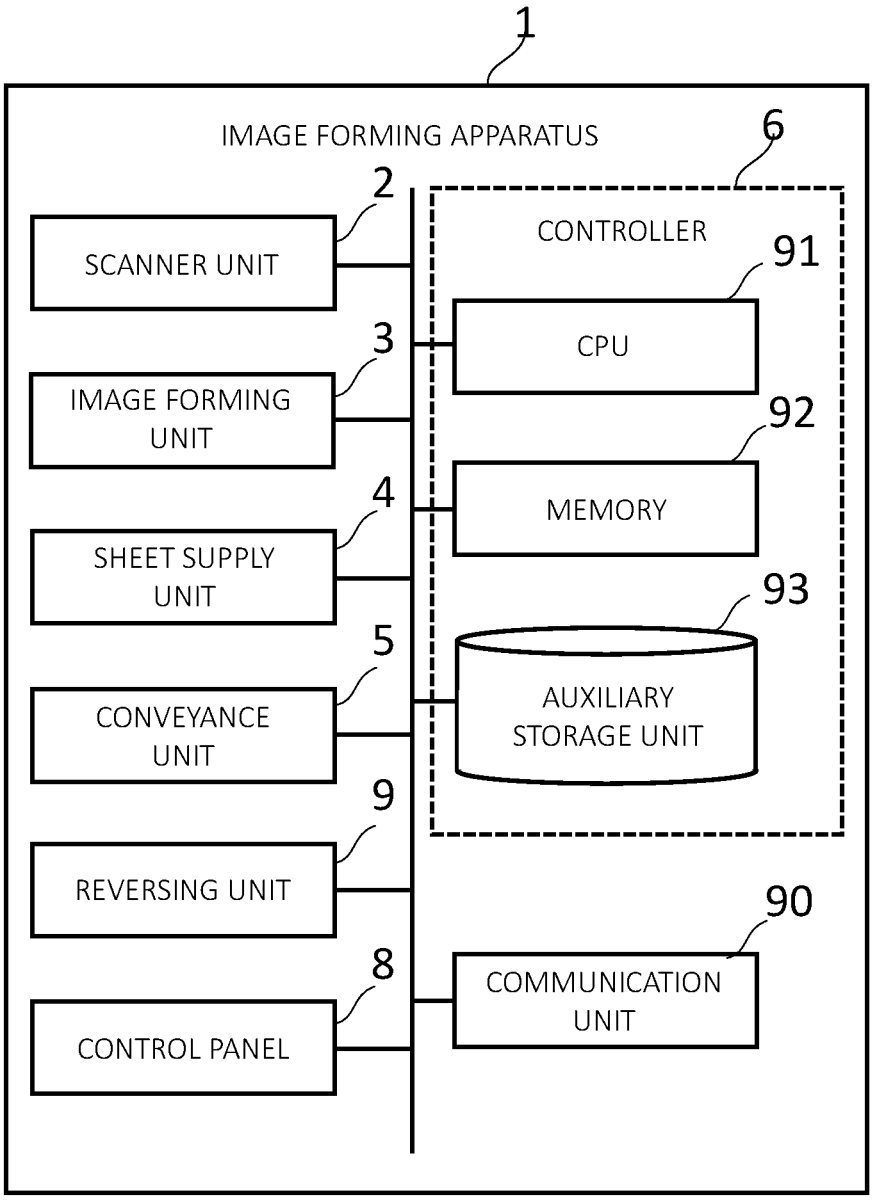
FIG. 2 depicts aspects of an image processing apparatus according to an embodiment.

FIG. 2 is a hardware configuration diagram of the image processing apparatus according to the embodiment. The image forming apparatus 1 includes a central processing unit (CPU) 91, a memory 92, an auxiliary storage device 93, and the like connected by a bus, and executes a program. Certain functions of image forming apparatus 1 such as functions of a scanner unit 2, an image forming unit 3, a sheet supply unit 4, a conveying unit 5, a reversing unit 9, a control panel 8, and a communication unit 90 are provided by executing a program.

The CPU 91 functions as the controller 6 by executing a program stored in the memory 92 and the auxiliary storage device 93. The controller 6 controls the operations of the image forming apparatus 1.

The auxiliary storage device 93 is a storage device such as a magnetic hard disk device or a semiconductor storage device. The auxiliary storage device 93 stores information.

The communication unit 90 includes a communication interface for connecting to an external device. The communication unit 90 communicates with the external device via a communication interface.

First Embodiment

Figure 3:
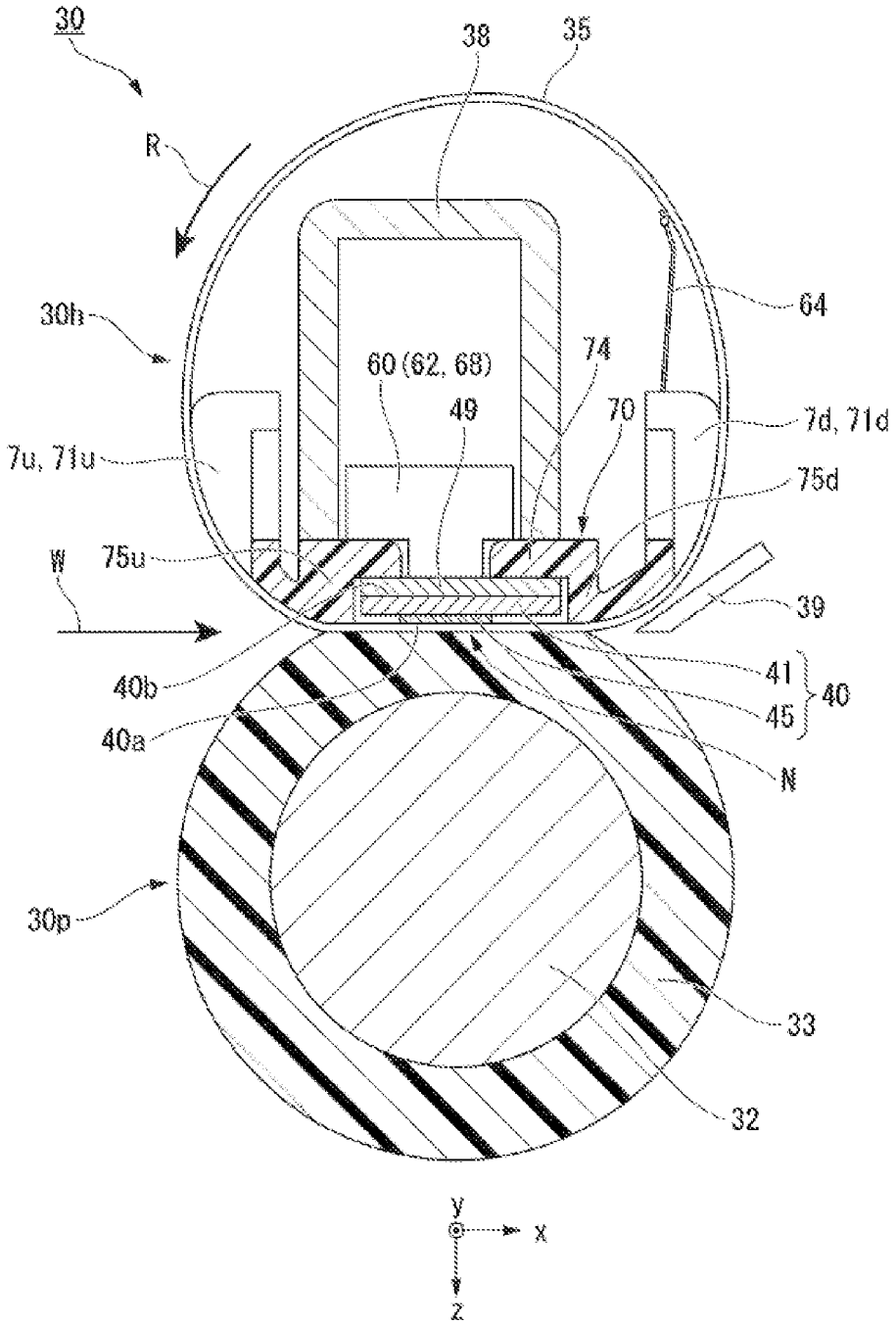
FIG. 3 is a cross-sectional view of a heating unit of a first embodiment.

FIG. 3 is a cross-sectional view of a heating unit of a first embodiment. The heating unit according to the first embodiment can be referred to as a fixing unit 30. The fixing unit 30 includes a pressing roller 30*p* and a film unit 30*h*.

The pressing roller 30*p* forms a nip N with the film unit 30*h*. The pressing roller 30*p* presses the toner image on the sheet S that has entered the nip N. The pressing roller 30*p* rotates (R arrow direction) to convey the sheet S through the nip N (in the W arrow direction). The pressing roller 30*p* includes a core metal 32, an elastic layer 33, and a release layer (not separately depicted).

The core metal 32 is formed into a columnar shape by a metal material such as stainless steel. Both end portions in the axial direction of the core metal 32 are rotatably supported. The core metal 32 is rotationally driven by a motor or the like. The core metal 32 abuts against a cam member. The cam member rotates so as to move the core metal 32 closer to or away from the film unit 30*h*.

The elastic layer 33 is formed of an elastic material such as silicone rubber. The elastic layer 33 is formed to have a constant thickness on the outer circumferential surface of the core metal 32.

The release layer is formed of a resin material such as PFA (tetrafluoroethylene-perfluoroalkylvinylether copolymer). The release layer is formed on the outer peripheral surface of the elastic layer 33.

The hardness of the outer peripheral surface of the pressing roller 30*p* is preferably 40 to 70 at a load of 9.8 N (Newtons) in an ASKER-C hardness meter. Thereby, the area of the nip N and the durability of the pressing roller 30*p* are ensured.

The pressing roller 30*p* can move closer to or away from the film unit 30*h* by the rotation of the cam member. When the pressing roller 30*p* is brought close to the film unit 30*h* and pressed by a pressing spring, the nip N is formed. On the other hand, if a jam occurs with the sheet S in the fixing unit 30, the pressing roller 30*p* can be moved away from the film unit 30*h*, so that it is possible to remove the sheet S. Furthermore, in a state in which the cylindrical film 35 is stopped rotating for a prolonged period, such as during a sleep mode, the pressing roller 30*p* can be separated from the film unit 30*h*, whereby a plastic deformation of the cylindrical film 35 can be prevented.

The pressing roller 30*p* rotates by being driven by a motor. When the pressing roller 30*p* rotates while forming the nip N, the cylindrical film 35 rotates in the rotation direction R. The pressing roller 30*p* rotates and thereby conveys the sheet S in the conveyance direction W.

The film unit 30*h* heats the toner image on the sheet S passing through the nip N. The film unit 30*h* includes a cylindrical film 35, a heater unit 40, a heat conductor 49, a support member 70, a stay 38, a peeling plate 39, a temperature sensing element 60, and a film temperature sensor 64.

The cylindrical film 35 has a cylinder shape and may be referred to in some contexts as fixing belt or a fixing drum or the like. The cylindrical film 35 has, in order from its inner peripheral side, a base layer, an elastic layer, and a release layer. The base layer is formed in a cylindrical shape by a metal material such as nickel (Ni), a resin material such as polyimide (PI), or the like. The elastic layer is laminated on the outer peripheral surface of the base layer. The elastic layer is formed of an elastic material such as silicone rubber. The release layer is laminated on the outer peripheral surface of the elastic layer. The release layer is formed of a material such as a PFA resin.

Figure 4:
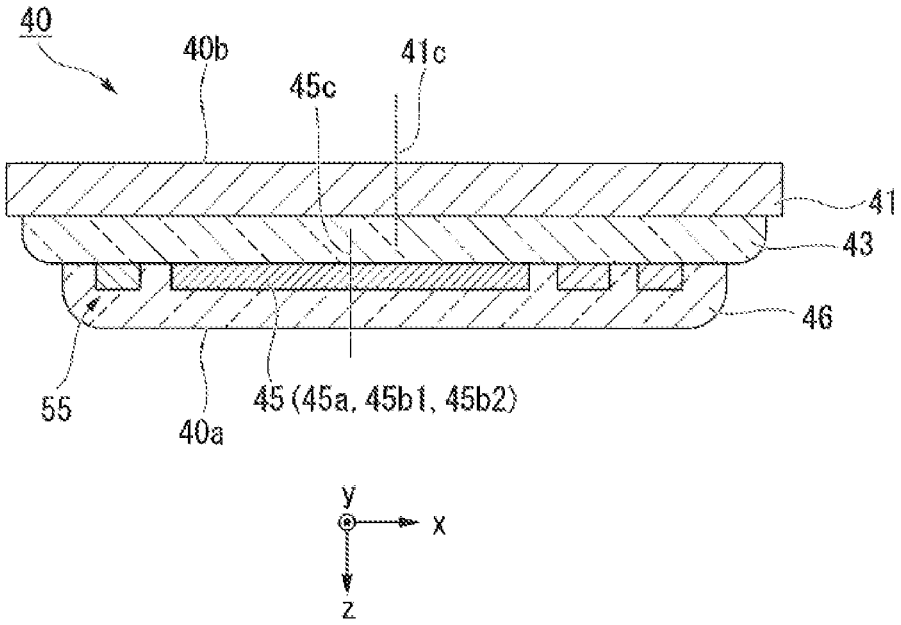
FIG. 4 is a cross-sectional view of a heater unit.
Figure 5:
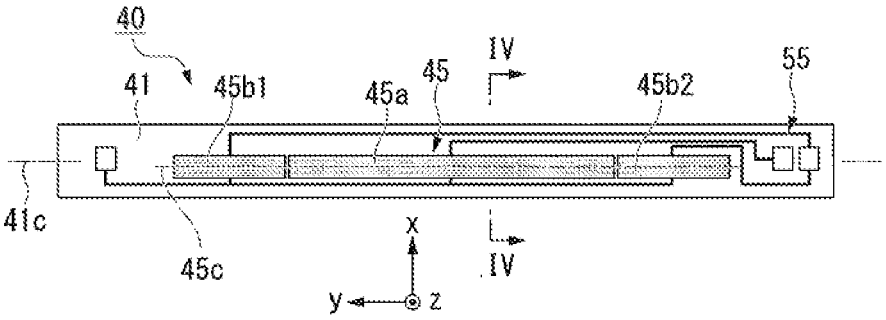
FIG. 5 is a bottom view of a heater unit.

FIG. 4 is a cross-sectional view of the heater unit taken along line IV-IV in FIG. 5. FIG. 5 is a bottom view (a view towards the −z direction) of the heater unit. The heater unit 40 includes a heating element substrate 41, a heating element group 45, and a wiring group 55.

The substrate 41 is formed of a metal material such as stainless steel, a ceramic material such as aluminum nitride, or the like. The substrate 41 is formed in a plate shape having an elongated rectangular shape. The substrate 41 is disposed radially inward of the cylindrical film 35. In the substrate 41, the axial direction of the cylindrical film 35 is defined as a longitudinal direction.

In the present application, a x direction, a y direction, and a z direction are defined as follows. The y direction is a longitudinal direction of the substrate 41. As will be described later, the +y direction is a direction from the central heating element 45*a* toward a first end heating element 45*b*1. The x direction is a short direction of the substrate 41, and the +x direction is the conveyance direction (downstream side) of the sheet S. The −z direction is a normal direction of the substrate 41. The +z direction is a direction in which the heating element group 45 is disposed with respect to the substrate 41, and is a direction in which a first surface 40*a* in contact with the cylindrical film 35 in the heater unit 40 is disposed. The −z direction is a direction opposite to the +z direction, and is a direction in which a second surface 40*b* in contact with the heat conductor 49 in the heater unit 40 is disposed. An insulating layer 43 is formed on the surface of substrate 41 in the +z direction by a glass material or the like.

As shown in FIG. 5, the heating element group 45 is disposed on the substrate 41. The heating element group 45 is formed of a silver-palladium alloy or the like. The outer shape of the heating element group 45 is in a rectangular shape having the y direction as a longitudinal direction and the x direction as a short direction. A center 45*c* of the heating element group 45 along the x direction is offset in the −x direction from a center 41*c* of the substrate 41.

The heating element group 45 has a plurality of heating elements (e.g., heating elements 45*a*, 45*b*1 and 45*b*2) arranged along the y direction. The heating element group 45 in this example includes a first end heating element 45*b*1, a central heating element 45*a*, and a second end heating element 45*b*2 which are arranged adjacently with each other along the y direction. The central heating element 45*a* is disposed in a central portion of the heating element group 45 along the y direction. The first end heating element 45*b*1 is disposed at the +y direction end of the heating element group 45 to the +y direction end side of the central heating element 45*a*. The second end heating element 45*b*2 is disposed at the −y direction end of the heating element group 45 to −y direction end side of the central heating element 45*a*.

The heating element group 45 generates heat when the individual heating elements are energized. A sheet S having a small width in the y direction can be positioned to pass through the central portion of the fixing unit 30 in the y direction. In this case, the controller 6 can cause only the central heating element 45*a* to generate heat. In the case of a sheet S having a large width in the y direction, the controller 6 causes the entirety of the heating element group 45 to generate heat. That is, the heat generation of the central heating element 45*a* and the first end heating element 45*b*1 and the second end heating element 45*b*2 can be controlled independently of each other according to the width of the sheet S being processed. Also, the first end heating element 45*b*1 and The second end heating element 45*b*2 can be controlled to generate heat in the same manner as each other.

As shown in FIG. 4, a heating element group 45 and a wiring group 55 are formed on a surface of the insulating layer 43 in the +z direction facing surface. The protective layer 46 is formed by a glass material or the like so as to cover the heating element group 45 and the wiring group 55. The protective layer 46 reduces sliding friction (improves slidability) between the heater unit 40 and the cylindrical film 35.

Similarly to the insulating layer 43 formed on the +z direction side of the substrate 41, an insulating layer may be formed on the −z direction side of the substrate 41. A protective layer similar to protect layer 46 may be formed on the −z direction side of the substrate 41. Thus, the substrate 41 can be prevented from warping.

As shown in FIG. 3, the heater unit 40 is disposed inside the cylindrical film 35. Generally, a grease is applied to the inner peripheral surface of the cylindrical film 35. The first surface 40*a* on the +z direction side of the heater unit 40 contacts the inner peripheral surface of the cylindrical film 35 via grease. When the heater unit 40 generates heat, the viscosity of the grease decreases. Accordingly, low friction (good slidability) between the heater unit 40 and the cylindrical film 35 is ensured.

The heat conductor 49 is formed of a metal material having a high thermal conductivity such as copper. An outer shape of the heat conductor 49 is equal to an outer shape of the substrate 41 of the heater unit 40. The heat conductor 49 is disposed in contact with at least a part of the second surface 40*b* in the −z direction of the heater unit 40.

The support member 70 is formed of a resin material such as a liquid crystal polymer. The support member 70 is formed so as to cover the −z direction of the heater unit 40 and the both sides in the x direction. The support member 70 supports the heater unit 40 via the heat conductor 49. The support member 70 supports the inner peripheral surface of the cylindrical film 35 at both ends of the heater unit 40 in the x direction. Details of the support member 70 will be described later.

When the sheet S passing through the fixing unit 30 is heated, a temperature distribution is generated in the heater unit 40 in accordance with the size of the sheet S. When the heater unit 40 locally reaches a high temperature, there is a possibility of exceeding the heat resistance temperature of the support member 70, which is formed of a resin material. The heat conductor 49 averages the temperature distribution of the heater unit 40. Accordingly, the heat stability of the support member 70 is improved.

The stay 38 is formed of a steel plate material or the like. A cross section perpendicular to the y direction of the stay 38 is formed in a U-shape. The stay 38 is mounted in the −z direction of the support member 70 so as to close the opening portion of the U shape with the support member 70.

The stay 38 extends in the y direction. Both ends of the stay 38 in the y direction are fixed to the housing of the image forming apparatus 1. Thereby, the film unit 30*h* is supported by the image forming apparatus 1. The stay 38 improves a bending rigidity of the film unit 30*h*. Flanges that restrict movement of the cylindrical film 35 in the y direction are attached to the vicinities of both ends of the stay 38 in the y direction.

The peeling plate 39 is disposed away from the nip N to the downstream side in the conveyance direction W. A −x direction end of the peeling plate 39 tapers toward the nip N, and is disposed in close proximity to the cylindrical film 35. The sheet S pressed in the nip N is typically discharged from the nip N in a state in which the sheet S is adhered to the cylindrical film 35. The peeling plate 39 assists in the separation of the sheet S from the cylindrical film 35.

The temperature sensing element 60 is disposed on the −z direction side of the heater unit 40. The temperature sensing element 60 is disposed on the −z direction facing surface of the heat conductor 49. The temperature sensing element 60 is disposed inside a hole passing through the support member 70 in the z direction. The temperature sensing element 60 comprises a heater temperature sensor 62 and a thermostat 68. The thermostat 68 can be used as shut-off device. For example, the heater temperature sensor 62 is a thermistor.

The heater temperature sensor 62 detects a temperature of the heater unit 40 via the heat conductor 49. The controller 6 (see FIG. 1) controls the energization of the heating element group 45 on the basis of the temperature detected by the heater temperature sensor 62 when the fixing unit 30 starts up.

When the temperature of the heater unit 40 (as detected through the heat conductor 49) exceeds a predetermined temperature, the thermostat 68 cuts off the energization of the heating element group 45. As a result, excessive heating of the cylindrical film 35 by the heater unit 40 can be prevented.

As shown in FIG. 3, the film temperature sensor 64 contacts the inner circumferential surface of the cylindrical film 35. The film temperature sensor 64 senses a temperature of the cylindrical film 35.

The controller 6 controls the energization of the heating element group 45 based on the detected temperature of the film temperature sensor 64 during the operation of the fixing unit 30.

As shown in FIG. 3, the support member 70 has a back member 74, an upstream member 75*u*, and a downstream member 75*d*. The back member 74 is disposed so as to cover the −z direction side of the heater unit 40. The back member 74 supports the heater unit 40 via the heat conductor 49. The upstream member 75*u* and downstream member 75*d* are integrally formed with the back member 74 as part of the support member 70. Alternatively, the back member 74, the upstream member 75*u*, and the downstream member 75*d* may be separately formed (rather than integrally formed) then joined or coupled to each other to form the support member 70.

The upstream member 75*u* is arranged on the upstream side of the heater unit 40 in the direction of rotation R of the cylindrical film 35. The upstream member 75*u* extends from the −x direction end of the back member 74 in the in the +z direction. The +z direction facing surface of the upstream member 75*u* is formed with a curve along the inner surface of the cylindrical film 35. The upstream member 75*u* supports the cylindrical film 35, thereby stabilizing the entry of the sheet S to the nip N.

The downstream member 75*d* is located on the downstream side of heater unit 40 in the direction of rotation R of cylindrical film 35. The downstream member 75*d* extends in the +z direction from the +x direction end of the back member 74. A +z direction facing surface of downstream member 75*d* is formed a curve along the inner surface of cylindrical film 35. The downstream member 75*d* supports the cylindrical film 35 so that the cylindrical film 35 is positioned to be proximate to the peeling plate 39. The sheet S discharged from the nip N is unlikely to enter the gap left between the cylindrical film 35 and the peeling plate 39. The sheet S is separated from the cylindrical film 35 by the peeling plate 39. This improves the peelability (release) of the sheet S from the cylindrical film 35.

The upstream member 75*u* has a first upstream rib 71*u*. The first upstream rib 71*u* is an example of an upstream rib 7*u*. The first upstream rib 71*u* extends in the circumferential direction of the cylindrical film 35. The first upstream rib 71*u* extends upstream from the upstream member 75*u* in the rotational direction R of the cylindrical film 35. The first upstream rib 71*u* can abut the inner surface of the cylindrical film 35.

The downstream member 75*d* has a first downstream rib 71*d*. The first downstream rib 71*d* is an example of a downstream rib 7*d*. The first downstream rib 71*d* extends in the circumferential direction of the cylindrical film 35. The first downstream rib 71*d* extends downstream of the downstream member 75*d* in the rotational direction R of the cylindrical film 35. The first downstream rib 71*d* can abut the inner surface of the cylindrical film 35.

Figure 6:
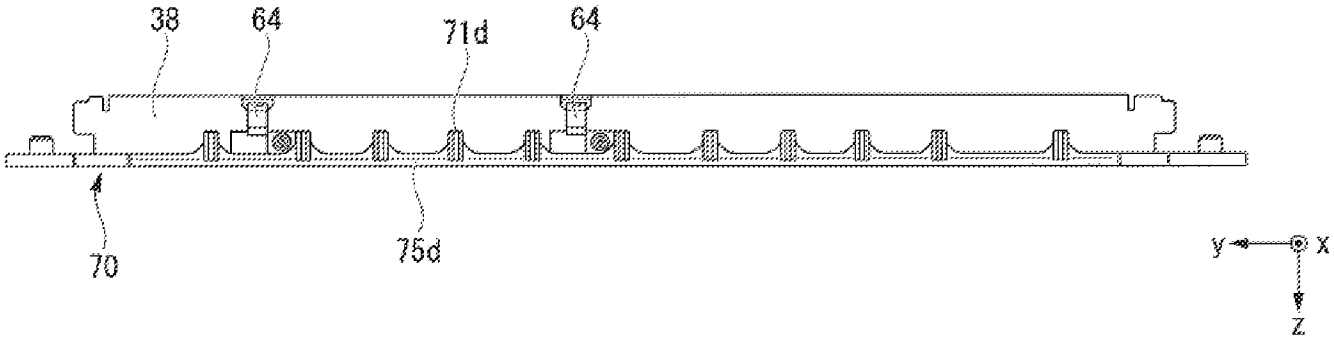
FIG. 6 is a side view of a periphery of a support member.

FIG. 6 is a side view of the periphery of the support member. The first downstream rib 71*d* is formed in a plate shape having a thickness direction in the y direction. A slit is formed in a central portion (along the y direction dimension) of the first downstream rib 71*d*. Accordingly, the contact area between the first downstream rib 71*d* and the cylindrical film 35 is reduced. The first upstream rib 71*u* is also formed in the same manner as the first downstream rib 71*d*. The first upstream rib 71*u* and the first downstream rib 71*d* guide the rotation of the cylindrical film 35. The cylindrical film 35 rotates while being held in a predetermined shape by the first upstream rib 71*u* and the first downstream rib 71*d*.

Figure 7:
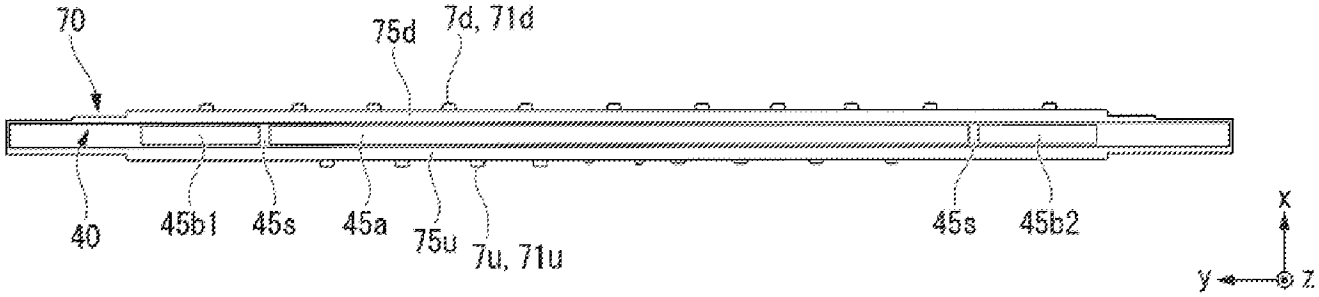
FIG. 7 is a bottom view of a periphery of a support member.

FIG. 7 is a bottom view of the periphery of the support member. A plurality of first upstream ribs 71*u* are arranged side by side in the y direction. The plurality of first downstream ribs 71*d* are also arranged side by side in the y direction. Each first downstream rib 71*d* is disposed at a position offset from the first upstream rib 71*u* in the y direction. That is, the first upstream rib 71*u* does not completely overlap the first downstream rib 71*d* in the y direction. At least a portion of the first downstream rib 71*d* does not overlap the first upstream rib 71*u* in the y direction. The first upstream rib 71*u* and the first downstream rib 71*d* have portions that do not overlap each other in the y direction. It is desirable that the first upstream rib 71*u* and the first downstream rib 71*d* do not have any portions overlapping each other in the y direction.

As described above, the fixing unit 30 heats and presses the toner image of the sheet S entering the nip N, and this fixes the toner image to the sheet S. The temperature of the cylindrical film 35 is preferably uniform in the y direction. The rotation of the cylindrical film 35 is guided by the first upstream rib 71*u* and the first downstream rib 71*d*. The abutment between the first upstream rib 71*u* and the first downstream rib 71*d* transfers the heat of the cylindrical film 35 to the first upstream rib 71*u* and the first downstream rib 71*d*. If the first upstream rib 71*u* and the first downstream rib 71*d* were arranged in the same (overlapping) position in the y direction, the temperature of the cylindrical film 35 will be significantly reduced at that position. This would cause temperature non-uniformity to occur in the fixing 30.

On the other hand, since the first upstream rib 71*u* and the first downstream rib 71*d* of the present embodiment are disposed at different positions from each other in the y direction. The position in the y direction at which the cylindrical film 35 abuts on the first upstream rib 71*u* and the position in the y direction at which the cylindrical film 35 abuts the first downstream rib 71*d* are different from each other. Thus, any temperature decrease of the cylindrical film 35 due to the first stream rib 71*u* or the first downstream rib 71*d* is distributed a different positions in the y direction. Therefore, the temperature non-uniformity of the fixing unit 30 is reduced. According to this, the printing quality of the fixing unit 30 can be improved.

As shown in FIG. 7, a boundary portion 45*s* is formed between the central heating element 45*a* of the heater unit 40 and the first end heating element 45*b*1. A boundary portion 45*s* is also formed between the central heating element 45*a* and the second end heating element 45*b*2. The boundary portion 45*s* is formed in parallel to the x direction. The boundary portion 45*s* may be formed so as to intersect the x direction. The first upstream rib 71*u* and the first downstream rib 71*d* are disposed at positions different from the boundary portion 45*s* in the y direction. That is, the boundary portion 45*s* and the first upstream rib 71*u* and the first downstream rib 71*d* have portions that do not overlap each other in the y direction. It is desirable that the boundary portion 45*s* and the first upstream rib 71*u* and the first downstream rib 71*d* do not have portions that overlap each other in the y direction.

The heater unit 40 does not generate heat at the boundary portion 45*s*. The temperature of the cylindrical film 35 at the same position in the y direction as the boundary portion 45*s* is lower than that in the other positions. If the first upstream rib 71*u* and the first downstream rib 71*d* are disposed at the same position along the y direction as the boundary portion 45*s* (gap between adjacent heating elements), the temperature of the cylindrical film 35 would be noticeably reduced at that overlapped position. This would cause temperature non-uniformity to occur in the fixing unit 30. However, the first upstream rib 71*u* and the first downstream rib 71*d* of the present embodiment are disposed at positions in the y direction different from (not overlapping) the boundary portion 45*s*. Thus, the temperature decrease of the cylindrical film 35 due to the abutment with the first upstream rib 71*u* and the first downstream rib 71*d* occurs at positions different from that of the boundary portion 45*s*. Therefore, the temperature non-uniformity of the fixing unit 30 is reduced.

As described above, the fixing unit 30 of the present embodiment has a cylindrical film 35, a heater unit 40, an upstream member 75*u*, a downstream member 75*d*, an upstream rib 7*u*, and a downstream rib 7*d*.

The heater unit 40 is disposed along an inner surface of the cylindrical film 35, and has a cylindrical film 35, and has a heating element group 45 in a longitudinal direction (y direction).

The upstream member 75*u* is disposed along the inner surface of the cylindrical film 35. The upstream member 75*u* is arranged upstream of the heater unit 40 in the direction of rotation R of the cylindrical film 35.

The downstream member 75*d* is disposed along the inner surface of the cylindrical film 35 and is disposed downstream of the heater unit 40 in the direction of rotation R of the cylindrical film 35.

The upstream rib 7*u* is formed in the upstream member 75*u*, extends in the circumferential direction of the cylindrical film 35, abuts against the inner surface of the cylindrical film 35, and is arranged side by side in the y direction.

The downstream rib 7*d* is formed in the downstream member 75*d* and extends in the circumferential direction of the cylindrical film 35 and can abut against the inner surface of the cylindrical film 35.

The downstream ribs 7*d* are arranged side by side in the y direction at a position different from that of the upstream rib 7*u*. This causes the temperature decrease of the cylindrical film 35 due to abutment with the upstream rib 7*u* and the downstream rib 7*d* to be distributed in the y direction. Therefore, the temperature non-uniformity of the fixing unit 30 is reduced.

The upstream rib 7*u* has a first upstream rib 71*u* extending upstream from the upstream member 75*u* in the rotational direction R of the cylindrical film 35.

The downstream rib 7*d* has a first downstream rib 71*d* extending downstream in the direction of rotation R of the cylindrical film 35 from the downstream member 75*d*.

The first upstream rib 71*u* and the first downstream rib 71*d* guide the rotation of the cylindrical film 35. Accordingly, deformation of the cylindrical film 35 is suppressed, and reliability is improved.

The heating element group 45 includes a plurality of heating elements 45*a*, 45*b*1 and 45*b*2 which are arranged side by side in the y direction. The upstream rib 7*u* and the downstream rib 7*d* are disposed at positions different from the boundary portion 45*s* of the plurality of heating elements 45*a*, 45*b*1 and 45*b*2 in the y direction.

Accordingly, the temperature decrease of the cylindrical film 35 due to the abutment with the upstream rib 7*u* and the downstream rib 7*d* occurs at a position different from that of the boundary portion 45*s*. Therefore, the temperature non-uniformity of the fixing unit 30 is reduced.

Second Embodiment

Figure 8:
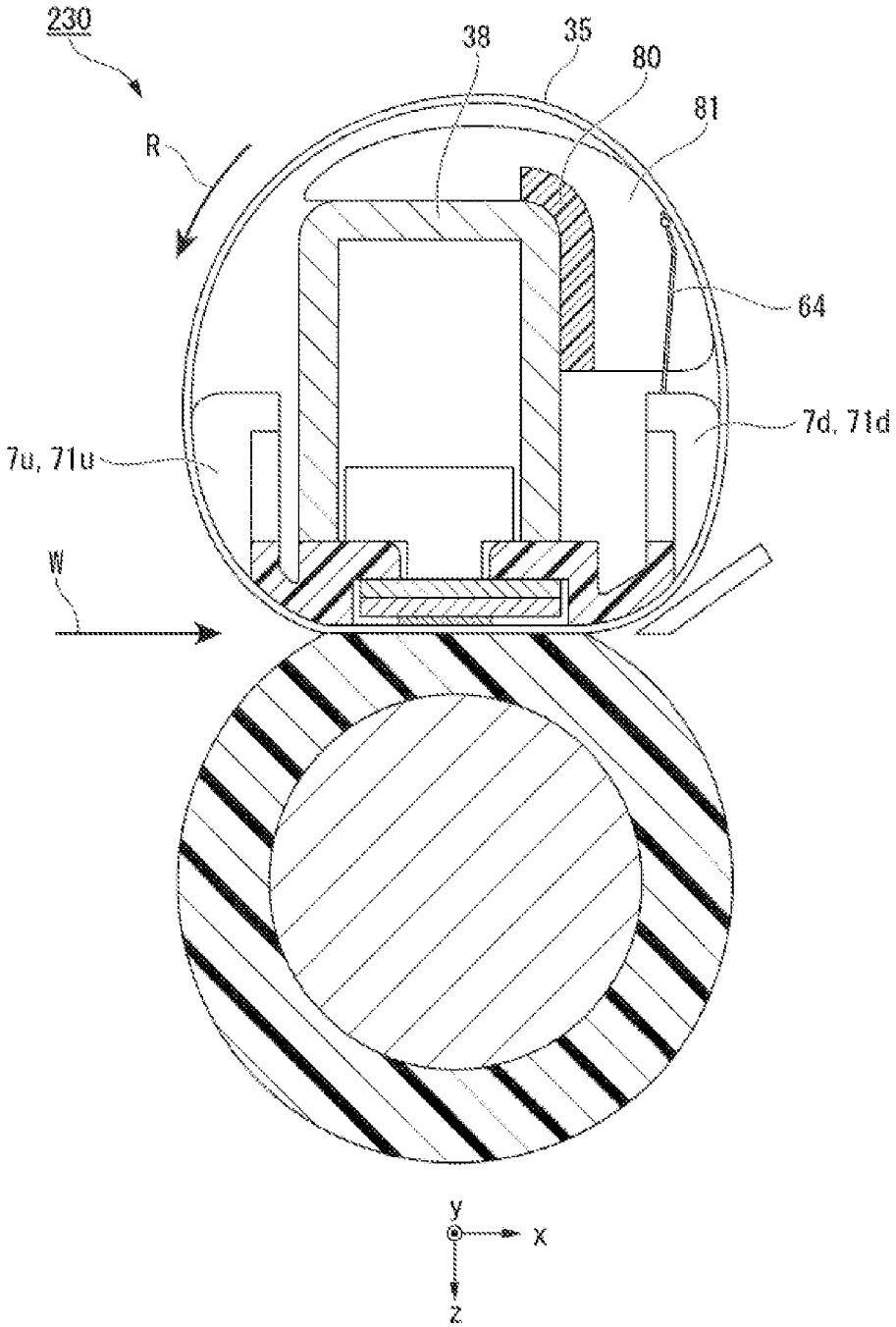
FIG. 8 is a cross-sectional view of a heating unit according to a second embodiment.

FIG. 8 is a cross-sectional view of a heating unit of a second embodiment. A fixing unit 230 which is a heating unit of the second embodiment is different from that of the first embodiment in that a guide rib 81 formed in a guide member 80 is provided. The description of the second embodiment that is the same as that in the first embodiment will be omitted.

The fixing unit 230 includes a guide member 80.

The guide member 80 is integrally formed of a resin material or the like. The guide member 80 is disposed inside the cylindrical film 35. The guide member 80 is fixed to the stay 38. The guide member 80 has a guide rib 81.

The guide rib 81 can abut against an inner surface of the cylindrical film 35. The guide rib 81 extends in the circumferential direction of the cylindrical film 35. The guide rib 81 is disposed in the vicinity of the film temperature sensor 64 in the circumferential direction of the cylindrical film 35. The film temperature sensor 64 is disposed downstream of the first downstream rib 71*d* in the rotational direction R of the cylindrical film 35. The guide rib 81 extends from near the downstream side of the first downstream rib 71*d* to the region on the opposite side of the heater unit 40 with the stay 38 interposed therebetween. The guide ribs 81 are disposed in most of the regions in which the first upstream rib 71*u* and first downstream rib 71*d* are not disposed in the circumferential direction of the cylindrical film 35.

In the cylindrical film 35 of the present embodiment, the base layer is formed of a resin material such as polyimide (PI). The cylindrical film 35 does not have a metal layer in this example. With a cylindrical film 35, in which the base layer is made of a resin material, such a film is relatively easily deformed. In some instances, the cylindrical film 35 may deform during rotation and move away from the film temperature sensor 64. In this case, the accuracy of the temperature detection of the cylindrical film 35 by the film temperature sensor 64 is reduced.

The guide ribs 81 guide the rotation of the cylindrical film 35 along with the first upstream ribs 71*u* and first downstream ribs 71*d*. As a result, deformation during rotation of the cylindrical film 35 is suppressed. Therefore, the accuracy of the temperature detection by the film temperature sensor 64 is improved.

Figure 9:
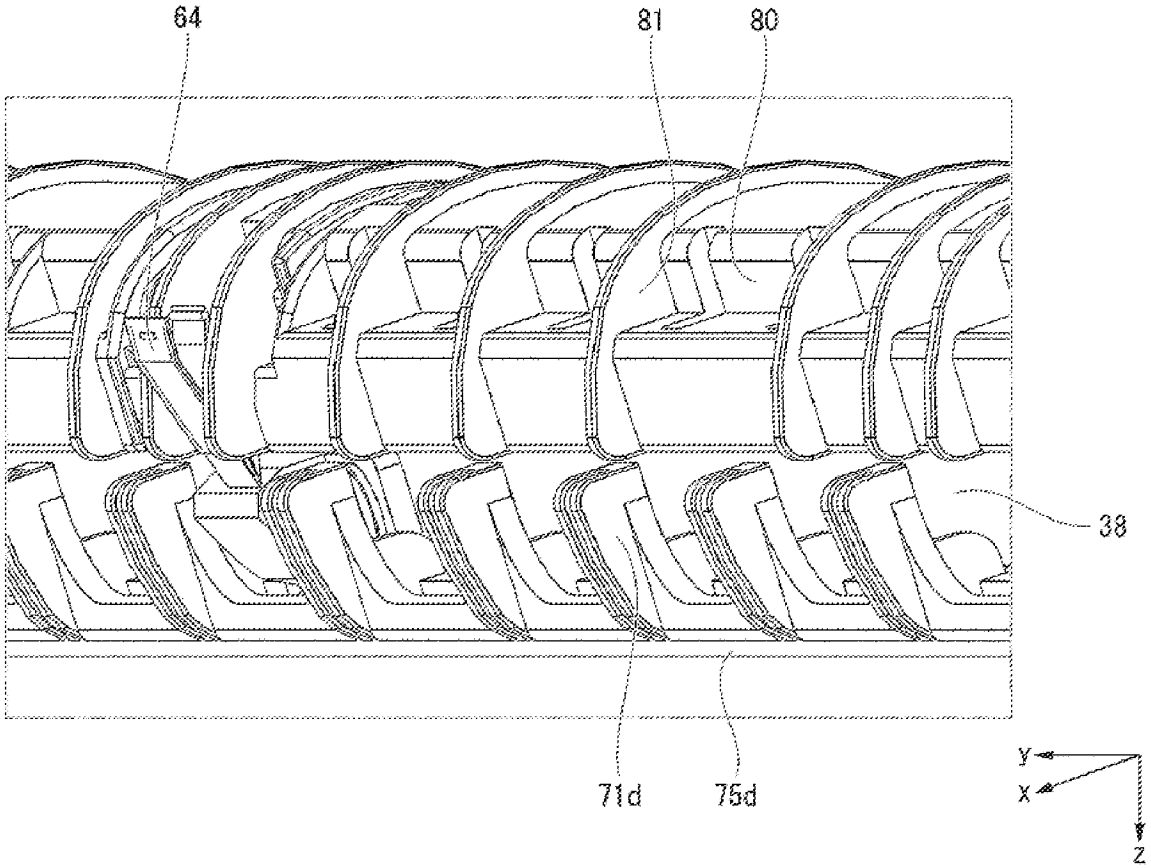
FIG. 9 is a perspective view of a support member and a guide member.

FIG. 9 is a perspective view of a support member and a guide member. The guide rib 81 is formed in a plate shape having a thickness direction in the y direction. The plurality of guide ribs 81 are arranged side by side in the y direction. The guide rib 81 is disposed at a position different from the first upstream rib 71*u* and the first downstream rib 71*d* in the y direction. That is, the guide rib 81 and the first upstream rib 71*u* and the first downstream rib 71*d* have portions that do not overlap each other in the y direction. It is desirable that the guide rib 81 and the first upstream rib 71*u* and the first downstream rib 71*d* do not have portions overlapping each other in the y direction.

The position in the y direction in which the cylindrical film 35 is in contact with the guide rib 81 is different from the position in the y direction in which the first upstream rib 71*u* contacts with the first downstream rib 71*d*. The temperature decrease of the cylindrical film 35 due to contact with the guide rib 81, the first upstream rib 71*u*, and the first downstream rib 71*d* is distributed in the y direction. Therefore, the temperature non-uniformity of the fixing unit 230 is reduced.

As described above, the fixing unit 230 of the present embodiment includes a film temperature sensor 64 and a guide rib 81. The film temperature sensor 64 measures the temperature of the inner surface of the cylindrical film 35. The guide rib 81 is disposed in the vicinity of the film temperature sensor 64 in the circumferential direction of the cylindrical film 35. The guide rib 81 extends in the circumferential direction of the cylindrical film 35, and can abut against the inner surface of the cylindrical film 35. The guide ribs 81 are arranged side by side at positions different from the upstream rib 7*u* and downstream rib 7*d* in the y direction.

Thereby, the temperature non-uniformity of the fixing unit 230 is reduced.

It is desirable that the guide rib 81, the first upstream rib 71*u*, and the first downstream rib 71*d* are disposed at positions different from the boundary portions 45*s* (see FIG. 7) of the plurality of heat generating elements in the y direction.

A first modified example of the second embodiment will be described.

Figure 10:
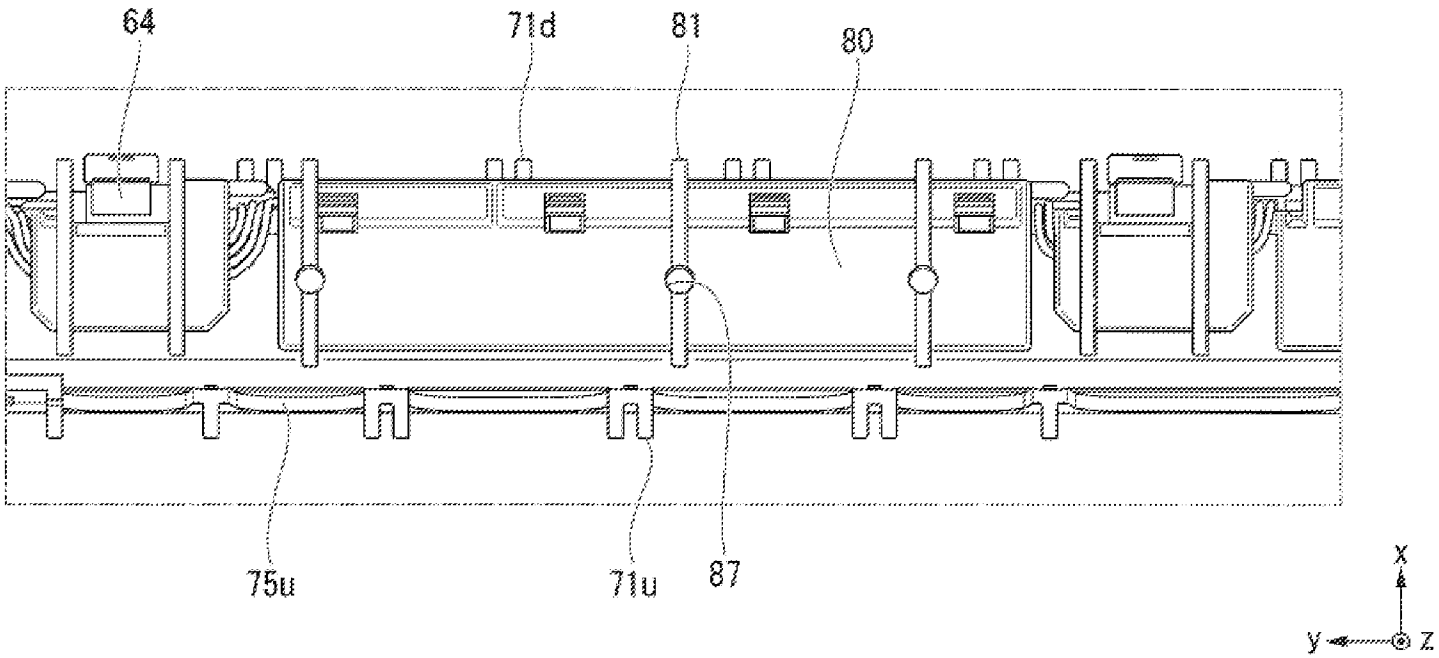
FIG. 10 is a bottom view of a guide member in a first modified example of the second embodiment.

FIG. 10 is a bottom view of a guide member according to a first modification of the second embodiment. The second modification of the first embodiment is different from the second embodiment in that it includes a hole portion 87.

The hole portion 87 passes through the guide member 80 and the guide rib 81 along the radial direction of the cylindrical film 35. The hole portion 87 is formed at a position in the y direction that is the same as that of the guide rib 81. The hole portion 87 is disposed at a +z direction end portion of the guide rib 81. In other examples, the hole portion 87 may be disposed at a position different from that depicted in FIG. 10 in the circumferential direction of the guide rib 81. The number of the hole portions 87 in the circumferential direction of the guide rib 81 is not limited to one, and may be two or more. In some examples, the hole portion 87 may be formed only in some of the guide ribs 81, or in other examples may be formed in all of the guide ribs 81. The hole portion 87 may be formed in the first upstream rib 71*u*, or may be formed in the first downstream rib 71*d*.

The hole portion 87 reduces the contact area between the guide rib 81 and the cylindrical film 35. The temperature decrease of the cylindrical film 35 due to the contact with the guide rib 81 is therefore suppressed. Therefore, the temperature non-uniformity of the fixing unit 230 is reduced.

A second modified example of the second embodiment will be described.

Figure 11:
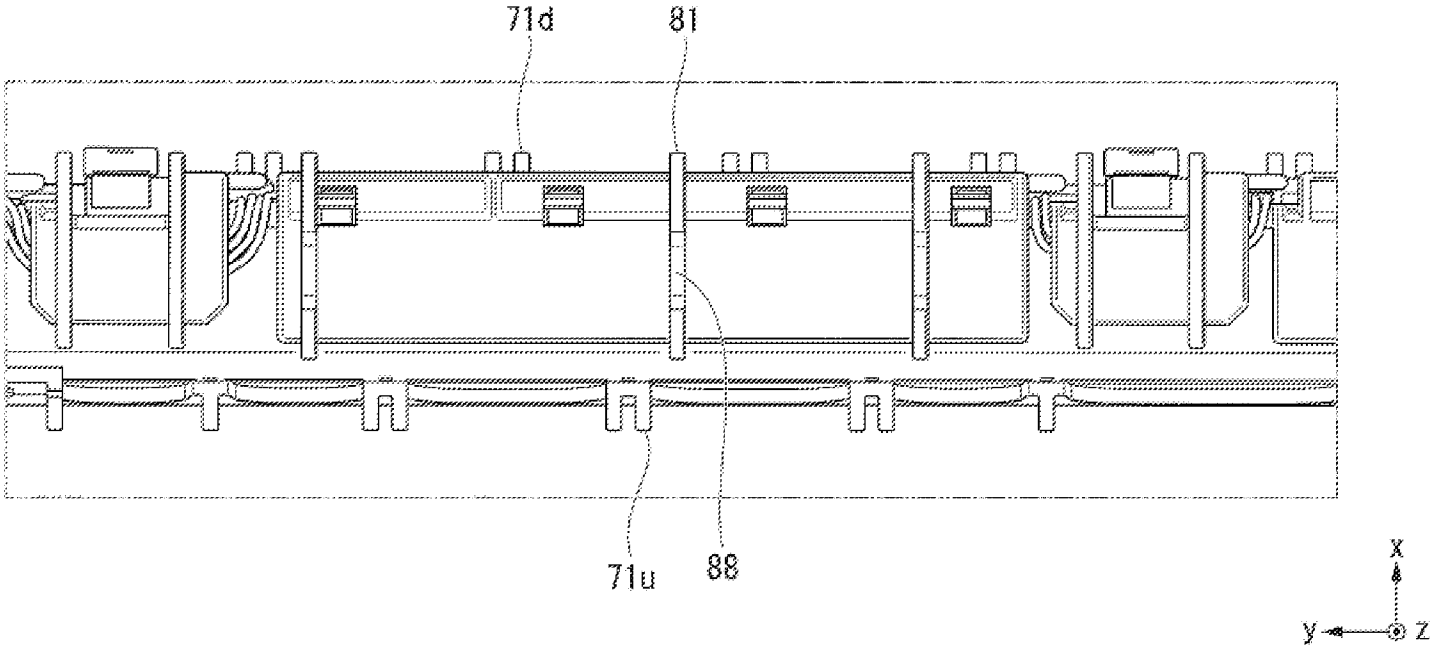
FIG. 11 is a bottom view of a guide member in a second modified example of the second embodiment.

FIG. 11 is a bottom view of a guide member according to a second modification of the second embodiment. The second modified example of the second embodiment is different from the second embodiment in that it has a cutout 88.

The cutout 88 is formed by cutting out a part of the outer periphery of the guide rib 81. The cutout 88 is disposed at a +z direction end portion of the guide rib 81. In other examples, the cutout 88 may be disposed at a position different from that depicted in FIG. 11 in the circumferential direction of the guide rib 81. The number of the cutouts 88 in the circumferential direction of the guide rib 81 is not limited to one, and may be two or more. In some examples, the cutout 88 may be formed only in some of the guide ribs 81, or may be formed in all of the guide ribs 81. The cutout 88 may be formed in the first upstream rib 71*u*, or may be formed in the first downstream rib 71*d*.

The contact area between the guide rib 81 and the cylindrical film 35 decreases due to the cutout 88. The temperature decrease of the cylindrical film 35 due to the contact with the guide rib is therefore suppressed. Therefore, the temperature non-uniformity of the fixing unit 230 is reduced.

A third modified example of the second embodiment will be described.

Figure 12:
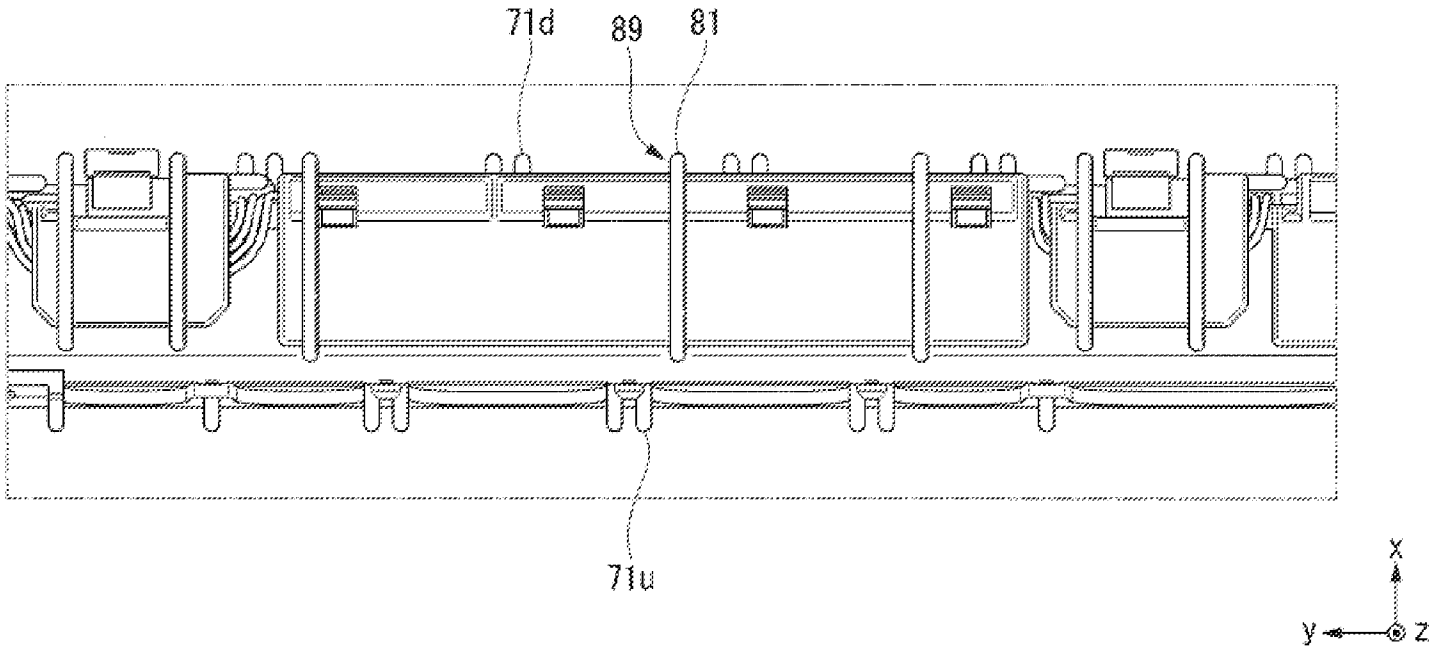
FIG. 12 is a bottom view of a guide member in a third modified example of the second embodiment.

FIG. 12 is a bottom view of a guide member according to a third modification of the second embodiment. The third modified example of the second embodiment is different from the second embodiment in that a curved surface 89 is provided.

The curved surface 89 is formed so that the thickness of the guide rib 81 continuously decreases in the outer periphery of the guide rib 81. The curved surface 89 is formed substantially on the entire outer periphery of the guide rib 81. In some examples, the curved surface 89 may be formed on only a part of the outer periphery of the guide rib 81. The curved surface 89 has an arc shape in a cross-section perpendicular to the circumferential direction of the guide rib 81. The radius of the arc is about half of the thickness of the guide rib 81. The curved surface 89 is in contact with the inner surface of the cylindrical film 35 in approximately only a narrow line. In some examples, the curved surface 89 may be formed only in some of the guide ribs 81, or may be formed in all of the guide ribs 81. The curved surface 89 may also be formed on the outer circumference of the first upstream rib 71*u*, and/or may be formed on the outer periphery of the first downstream rib 71*d*. Curved surface 89 may be referred to as a rounded surface in some contexts.

The curved surface 89 reduces the contact area between the guide rib 81 and the cylindrical film 35. The temperature decrease of the cylindrical film 35 due to the contact with the guide rib 81 is therefore suppressed. Therefore, the temperature non-uniformity of the fixing unit 230 is reduced.

Third Embodiment

Figure 13:
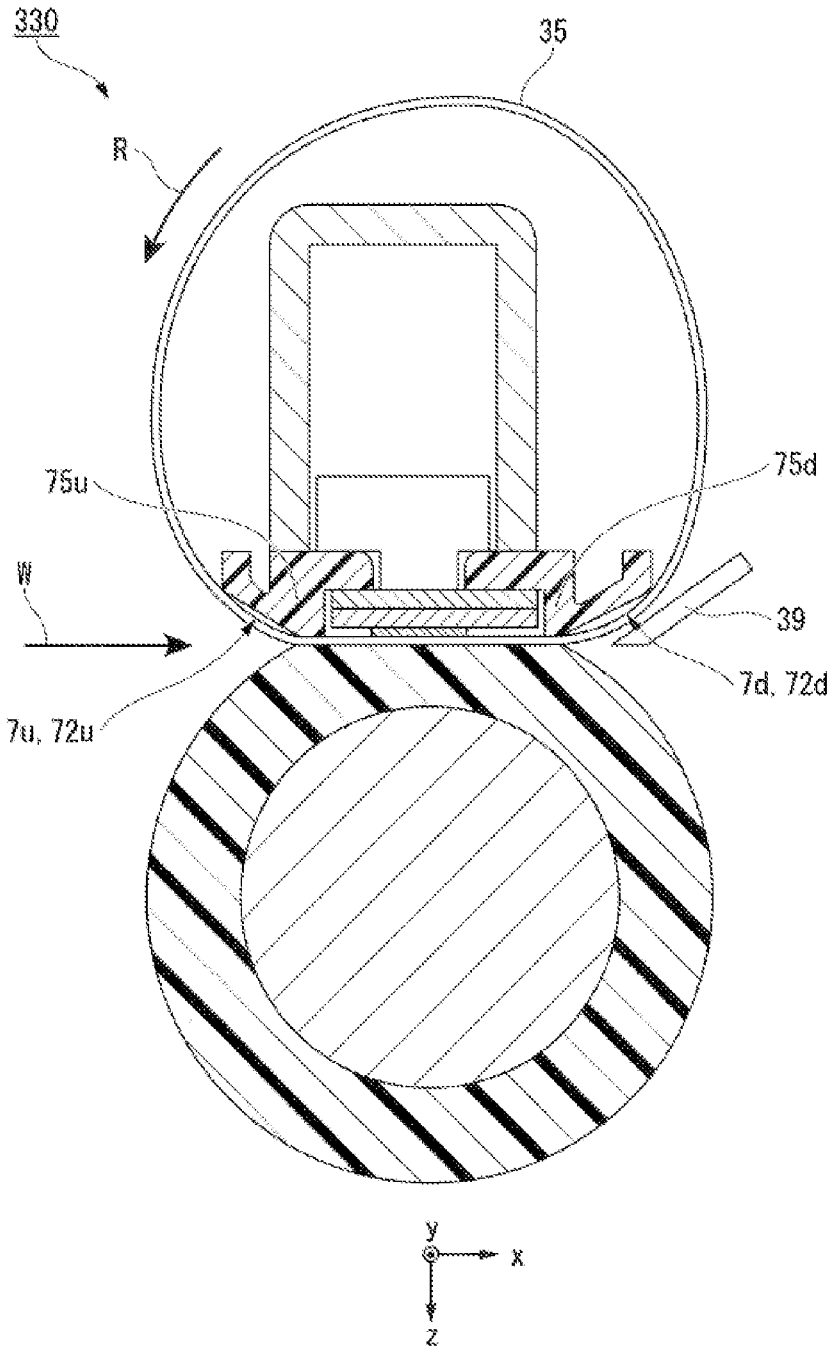
FIG. 13 is a cross-sectional view of a heating unit according to a third embodiment.

FIG. 13 is a cross-sectional view of a heating unit of a third embodiment. A fixing unit 330, which is a heating unit of the third embodiment, is different from the heating unit of the first embodiment in that the heating unit includes a second upstream rib 72*u* as an upstream rib 7*u* and a second downstream rib 72*d* as a downstream rib 7*d*.

The second upstream rib 72*u* is formed on a +z direction surface of the upstream member 75*u* along the inner surface of the cylindrical film 35. The second upstream rib 72*u* can abut the inner surface of the cylindrical film 35. The second downstream rib 72*d* is formed on a +z direction surface of the downstream member 75*d* along the inner surface of the cylindrical film 35. The second downstream rib 72*d* can abut the inner surface of the cylindrical film 35.

Figure 14:
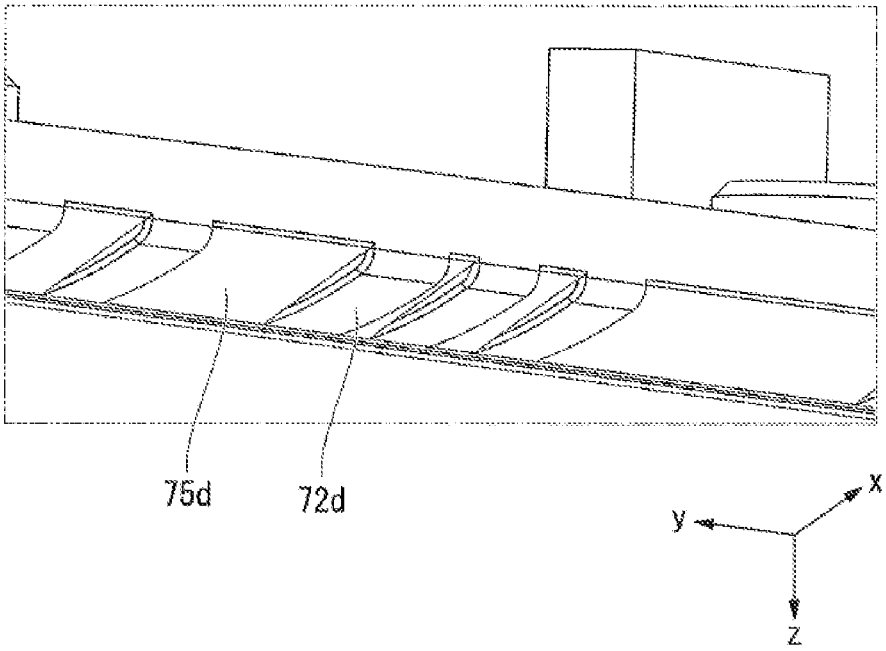
FIG. 14 is a perspective view of a support member.

FIG. 14 is a perspective view of a support member. The second downstream rib 72*d* extends in the circumferential direction of the cylindrical film 35. The width of the second downstream rib 72*d* in the y direction is substantially constant. The second downstream rib 72*d* is formed substantially in the entirety of the downstream member 75*d* in the x direction. The height of the second downstream rib 72*d* in the z direction increases with distance along the +x direction. The second upstream rib 72*u* is also formed in the same manner as the second downstream rib 72*d*.

Figure 15:
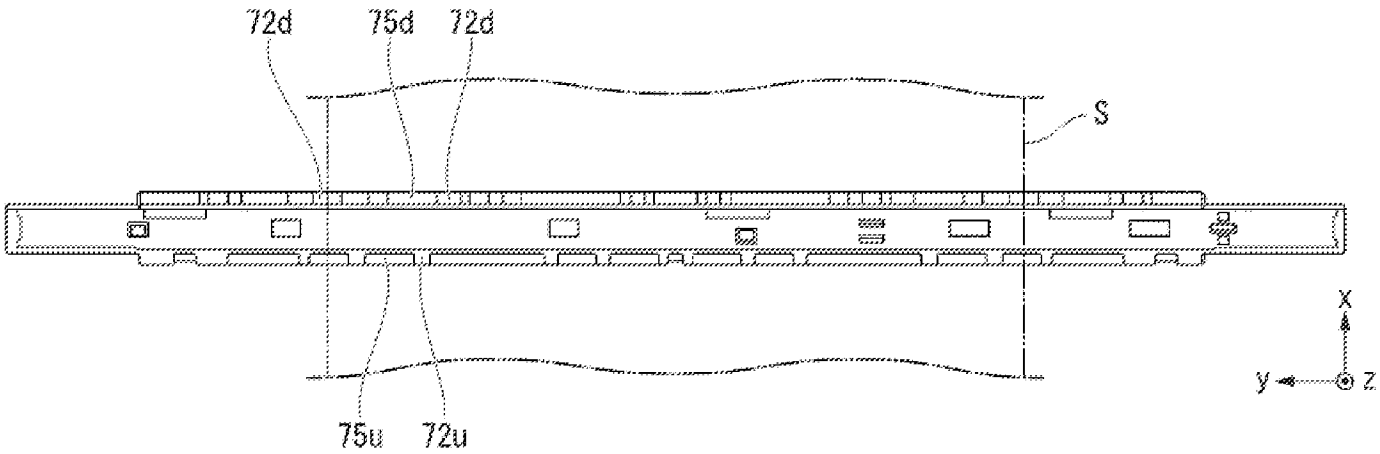
FIG. 15 is a bottom view of a support member.

FIG. 15 is a bottom view of the support member. A plurality of second upstream ribs 72*u* are arranged side by side in the y direction. A plurality of second downstream ribs 72*d* are arranged side by side in the y direction.

The cylindrical film 35 abuts on the surfaces of the second upstream rib 72*u* and the second downstream rib 72*d* in the +z direction. The cylindrical film 35 is unlikely to abut the surfaces of the second upstream rib 72*u* and the second downstream rib 72*d* in the +z direction of the upstream member 75*u* and downstream member 75*d*. This reduces the contact area between the cylindrical film 35 and the upstream member 75*u* and downstream member 75*d*. The temperature reduction of the cylindrical film 35 due to contact with the upstream member 75*u* and the downstream member 75*d* is suppressed. A time required for the heater unit 40 to heat the cylindrical film 35 to the fixing temperature is shortened. This reduces a time taken for the image forming apparatus 1 to return from a print standby state to a printable state.

The second downstream rib 72*d* is disposed at a position different from the second upstream rib 72*u* in the y direction. That is, the second upstream rib 72*u* and the second downstream rib 72*d* have portions that do not overlap each other in the y direction. It is desirable that the second upstream rib 72*u* and the second downstream rib 72*d* do not have any portions overlapping each other in the y direction.

A position in the y direction in which the cylindrical film 35 abuts on the second upstream rib 72*u* and a position in the y direction in contact with the second downstream rib 72*d* are different from each other. The temperature decrease of the cylindrical film 35 due to the abutment of the second upstream rib 72*u* and the second downstream rib 72*d* is distributed along the y direction. Therefore, the temperature non-uniformity of the fixing unit 330 is reduced.

The second downstream rib 72*d* is formed in a region including both y direction end portions of the sheet S. Sheets S of various sizes enter the fixing unit 330. The plurality of second downstream ribs 72*d* are formed in a region including both y direction ends of the sheets S of the various sizes.

As shown in FIG. 13, the second downstream rib 72*d* supports cylindrical film 35. Near the second downstream rib 72*d*, the cylindrical film 35 is disposed close to the peeling plate 39 at both y direction ends of the sheet S. In general, both leading edge corners of a sheet S discharged from the nip N do not easily enter the space left between the cylindrical film 35 and the peeling plate 39. This reduces angular folding or jamming of the sheet S.

As detailed above, the upstream rib 7*u* has a second upstream rib 72*u* formed on the surface of the upstream member 75*u* along the inner surface of the cylindrical film 35. The downstream rib 7*d* has a second downstream rib 72*d* formed on the surface of the downstream member 75*d* along the inner surface of cylindrical film 35.

The cylindrical film 35 abuts against the second upstream rib 72*u* and the second downstream rib 72*d*. Accordingly, the temperature decrease of the cylindrical film 35 due to contact with the upstream member 75*u* and downstream member 75*d* is suppressed. Therefore, the time taken for the image forming apparatus 1 to return from a print standby state to a printable state is shortened.

The second downstream rib 72*d* is formed in a region including both y direction end portions of the sheet S.

At the second downstream rib 72*d*, the cylindrical film 35 is disposed close to the peeling plate 39 at both y direction ends of the sheet S. The leading edge corners of the sheet S are less likely to enter between the cylindrical film 35 and the peeling plate 39. Therefore, it is possible to suppress sheet S jams.

The fixing unit 330 of the third embodiment has a second upstream rib 72*u* as the upstream rib 7*u* and a second downstream rib 72*d* as the downstream rib 7*d*. In other examples, the fixing unit 330 may have a second upstream rib 72*u* of the first embodiment in addition to the first upstream rib 71*u*. In some examples, the fixing unit 330 may have a second downstream rib 72*d* of the first embodiment in addition to the first downstream rib 71*d*. It is desirable, in general, that the first upstream rib 71*u*, the first downstream rib 71*d*, the second upstream rib 72*u*, and the second downstream rib 72*d* are disposed at different positions in the y direction.

In the third embodiment, it is desirable that the second upstream rib 72*u* and the second downstream rib 72*d* are disposed at positions different from the boundary portions 45*s* (see FIG. 7) between the plurality of heating elements in the y direction.

The fixing unit 330 according to the third embodiment may also include a guide rib 81 according to the second embodiment. It is desirable that the guide rib 81, the second upstream rib 72*u*, and the second downstream rib 72*d* are disposed at different positions in the y direction.

A first modified example of the third embodiment will be described.

Figure 16:
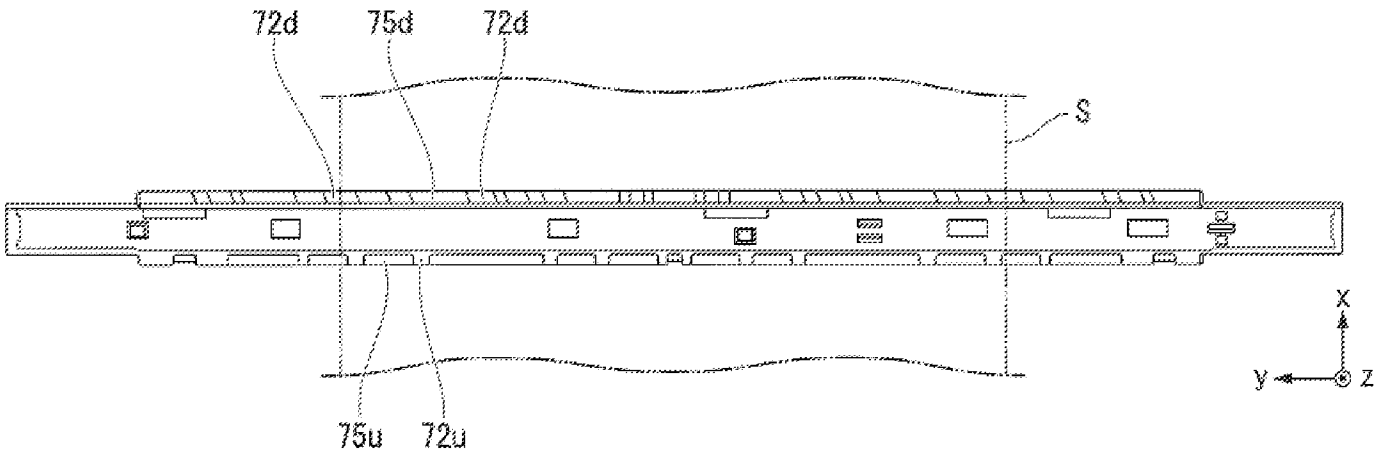
FIG. 16 is a bottom view of a support member according to a first modification of the third embodiment.

FIG. 16 is a bottom view of a supporting member according to a first modification of the third embodiment. The first modified example of the third embodiment is different from the third embodiment in that the third downstream rib 72*d* is inclined.

The second downstream rib 72*d* extends obliquely so as to intersect the x direction. The second downstream rib 72*d* is angled towards the +y direction with distance in the +x direction. The width in the y direction of the second downstream rib 72*d* of this first modified example illustrated in FIG. 16 is equal to the width in the y direction of the second downstream rib 72*d* of the third embodiment shown in FIG. 15. That is, the contact area between the second downstream rib 72*d* of the first modified example and the cylindrical film 35 is equal to the contact area between the second downstream rib 72*d* of the third embodiment and the cylindrical film 35. Accordingly, the temperature decrease of the cylindrical film 35 due to the contact with the second downstream rib 72*d* is reduced.

In some cases, a sheet S is discharged from the nip N in a state in which the sheet S has been displaced in the y direction. Since the second downstream rib 72*d* is inclined, the width in the y direction of the cylindrical film 35 supported by the second downstream rib 72*d* is increased. Even when the sheet S is discharged misaligned (offset) in the y direction, the corner portion of the sheet S will not easily enter between the cylindrical film 35 and the peeling plate 39. This suppresses angular folding or jamming of the sheet S.

The image processing apparatus according to the above example embodiments is an image forming apparatus 1, and the heating unit is one of the fixing units 30, 230, and 330. In other examples, the image processing apparatus of an embodiment may be a decoloring apparatus, and the heating unit may be a decoloring unit. A decoloring apparatus performs a process of decoloring (erasing) an image formed on the sheet by a decolorable toner. The decoloring unit heats the decolorable toner image already formed on the sheet to erase the already formed (and previously fixed) image from the sheet. The decoloring unit passes the sheet through a nip and thus heats the decoloring toner image to a decoloring temperature.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed:

1. A heating unit, comprising:

a rotating cylinder of a film material, the rotating cylinder having a length in a first direction and being configured to rotate about an axis parallel to the first direction;

a heater on an inner surface of the rotating cylinder, the heater having a length in the first direction and a width in a second direction orthogonal to the first direction, the second direction aligned with a rotational direction of the rotating cylinder;

a support member holding the heater in a fixed position relative to the rotating cylinder, the support member including:

an upstream member on the inner surface of the rotating cylinder, adjacent to the heater in the second direction on an upstream side of the heater in the rotational direction of the rotating cylinder, a downstream member on the inner surface of the rotating cylinder, adjacent to the heater in the second direction on a downstream side of the heater in the rotational direction of the rotating cylinder cylindrical portion, a plurality of upstream ribs on the upstream member, the upstream ribs extending in a third direction orthogonal to the second direction, each upstream rib having a curved shape facing the inner surface of the rotating cylinder, the upstream ribs supporting the rotating cylinder and spaced from each other in the first direction, and a plurality of downstream ribs on the downstream member, the downstream ribs extending in the third direction, each downstream rib having a curved shape facing the inner surface of the rotating cylinder, the downstream ribs supporting the rotating cylinder and spaced from each other in the first direction;

a stay supporting the support member in a fixed position, the stay extending in the first direction and surrounded by the rotating cylinder;

a guide member on an end of the stay opposite in the third direction from the heater, the guide member including a plurality of guide ribs with a curved shape facing the inner surface of the rotating cylinder, the guide ribs supporting the rotating cylinder and spaced from each other in the first direction; and a temperature sensor contacting the inner surface of the rotating cylinder at a position adjacent to one of the guide ribs.

2. The heating unit according to claim 1, wherein the upstream ribs and the downstream ribs are at non-overlapping positions along the first direction.

3. The heating unit according to claim 2, wherein the heater comprises a plurality of heating elements spaced from each other along the first direction, and gaps between adjacent heating elements do not overlap with the positions of the upstream ribs along the first direction and the positions of the downstream ribs along the first direction.

4. The heating unit according to claim 1, wherein the heater comprises a plurality of heating elements spaced from each other along the first direction, and gaps between adjacent heating elements do not overlap with the positions of the upstream ribs along the first direction and the positions of the downstream ribs along the first direction.

5. The heating unit according to claim 1, wherein the rotating cylinder comprises a polyimide film.

6. The heating unit according to claim 1, wherein the support member is a resin material.

7. The heating unit according to claim 1, wherein the curved shape of each upstream rib facing the inner surface of the rotating cylinder has a surface that is rounded along the first direction and in contact with the inner surface of the rotating cylinder.

8. The heating unit according to claim 1 wherein the stay is a U-shaped metal member with an open end of the U-shape facing towards the heater.

9. The heating unit according to claim 1, further comprising:

a press roller opposite the heater in the third direction, the press roller configured to press against an outer surface of the rotating cylinder.

10. The heating unit according to claim 1, further comprising:

a peeling plate outside the rotating cylinder to a downstream side of the heater, the peeling plate being proximate to an outer surface of the rotating cylinder.

11. The heating unit according to claim 10, wherein the downstream ribs extend along the second direction to a length that is greater than a length to which the upstream ribs extend in the second direction.

12. An image forming apparatus, comprising:

a press roller having a length in a first direction and configured to rotate about an axis parallel to the first direction;

a rotating cylinder of a film material, the rotating cylinder having a length in the first direction and configured to rotate about an axis parallel to the first direction;

a heater unit on an inner surface of the rotating cylinder, the heater unit having a length in the first direction and a width in a second direction orthogonal to the first direction, the second direction aligned with a rotational direction of the rotating cylinder;

a support member holding the heater unit in a fixed position relative to the rotating cylinder; and a sheet conveyor configured to transport a sheet to a nip formed between the rotating cylinder and the press roller at position corresponding to the fixed position of the heater unit;

a stay supporting the support member in a fixed position, the stay extending in the first direction and surrounded by the rotating cylinder;

a guide member on an end of the stay opposite in the third direction from the heater unit, the guide member including a plurality of guide ribs with a curved shape facing the inner surface of the rotating cylinder, the guide ribs supporting the rotating cylinder and spaced from each other in the first direction; and a temperature sensor contacting the inner surface of the rotating cylinder at a position adjacent to one of the guide ribs, wherein the support member includes:

an upstream member on the inner surface of the rotating cylinder, adjacent to the heater unit in the second direction on an upstream side of the heater unit in the rotational direction of the rotating cylinder, a downstream member on the inner surface of the rotating cylinder, adjacent to the heater unit in the second direction on a downstream side of the heater unit in the rotational direction of the rotating cylinder cylindrical portion, a plurality of upstream ribs on the upstream member, the upstream ribs extending in a third direction orthogonal to the second direction, each upstream rib having a curved shape facing the inner surface of the rotating cylinder, the upstream ribs supporting the rotating cylinder and spaced from each other in the first direction, and a plurality of downstream ribs on the downstream member, the downstream ribs extending in the third direction, each downstream rib having a curved shape facing the inner surface of the rotating cylinder, the downstream ribs supporting the rotating cylinder and spaced from each other in the first direction.

13. The image forming apparatus according to claim 12, wherein the upstream ribs and the downstream ribs are at non-overlapping positions along the first direction.

14. The image forming apparatus according to claim 13, wherein the heater unit comprises a plurality of heating elements spaced from each other along the first direction, and gaps between adjacent heating elements do not overlap with the positions of the upstream ribs along the first direction and the positions of the downstream ribs along the first direction.

* * * * *